US005207174A

United States Patent [19]

Fabbrini

[11] Patent Number: 5,207,174

[45] Date of Patent: May 4, 1993

[54] PENCIL EMBLEM COMBINATION

[76] Inventor: Howard M. Fabbrini, 735 Holly Rd., Cadillac, Mich. 49601

[21] Appl. No.: 819,815

[22] Filed: Jan. 13, 1992

[51] Int. Cl.[5] ..... G09F 17/00

[52] U.S. Cl. ..... 116/173; 40/334; D11/165

[58] Field of Search ..... 40/316, 317, 334, 594, 40/630, 905, 335; 116/173, 174, 175; 401/52, 194; D11/165, 166, 167, 181

[56] References Cited

U.S. PATENT DOCUMENTS

| | | | |
|---|---|---|---|
| 671,387 | 4/1901 | Porter | 401/52 |
| 1,322,966 | 11/1919 | Sinclair | 401/52 |
| 2,248,145 | 7/1941 | Wilder | 40/334 |
| 2,632,269 | 3/1953 | Sanders | 116/173 |
| 2,638,867 | 5/1953 | Felton | 116/173 |
| 3,138,249 | 6/1964 | Paulini | 116/173 |
| 3,636,912 | 1/1972 | Kamp | 116/28 R |

FOREIGN PATENT DOCUMENTS

| | | | |
|---|---|---|---|
| 1119276 | 6/1956 | France | 116/173 |
| 89/05236 | 6/1989 | World Int. Prop. O. | 40/334 |

*Primary Examiner*—William A. Cuchlinski, Jr.
*Assistant Examiner*—W. Morris Worth
*Attorney, Agent, or Firm*—Price, Heneveld, Cooper, DeWitt & Litton

[57] ABSTRACT

A pencil attachment for combination with a writing instrument, being an elongated flexible decorative element with a central portion and two end portions, having a front surface and a back surface, the front surface of the end portions having decorative indicia of an institution or franchise thereon, the back surface having an adhesive to enable adhesive attachment around a pencil and together to form a simulated pennant on a pencil flag pole.

4 Claims, 1 Drawing Sheet

PENCIL EMBLEM COMBINATION

BACKGROUND OF THE INVENTION

This invention relates to a novelty item, and particularly a flag simulating pencil decoration.

Students develop a loyalty to particular institutions such as their own school, e.g., high school, or an institution of higher learning such as a college or university. Demonstration of particular loyalties is often expressed visually by wearing particular clothing. However, inasmuch as the cost of special clothing is often not affordable and/or constitutes an unwise expenditure, there is a need for an inexpensive yet visually effective manner in which to express such a loyalty.

SUMMARY OF THE INVENTION

An object of this invention is to provide a catchy, visually effective, inexpensive, nondestructive manner in which to express loyalty and/or favor for a particular institution or franchise. The invention enables combination with a conventional pencil or equivalent writing instrument, of an inexpensive but potentially colorful pennant or flag, such that visual observation of the pencil, particularly when being used, imparts an immediate clear indication of the individual loyalty for that institution or franchise. The attachment can be readily applied to a pencil by a student without any difficulty, or ultimately removed therefrom.

The attachment has a pair of decorative end portions straddling a central portion which is of sufficient length to be wrapped around and encompass the pencil. An adhesive on the back surface, i.e., inner surface, of the attachment secures the central portion to the pencil and secures the end portions together back to back, causing the decorative element to extend transversely to the elongated pencil. The front, i.e., outer surfaces of the attachment, have decorative indicia thereon of a particular color, institution or franchise, to be readily visible. The attachment preferably has a cutout in the central portion, leaving spaced wrap around strips. The end portions are preferably of a triangular configuration with the apex spaced from the central portion, to resemble a pennant type of flag.

These and several other objects, advantages and features of the invention will become apparent upon studying the following detailed specification setting forth an illustrative embodiment of the invention.

DESCRIPTION OF THE PREFERRED EMBODIMENT

Figure 1:
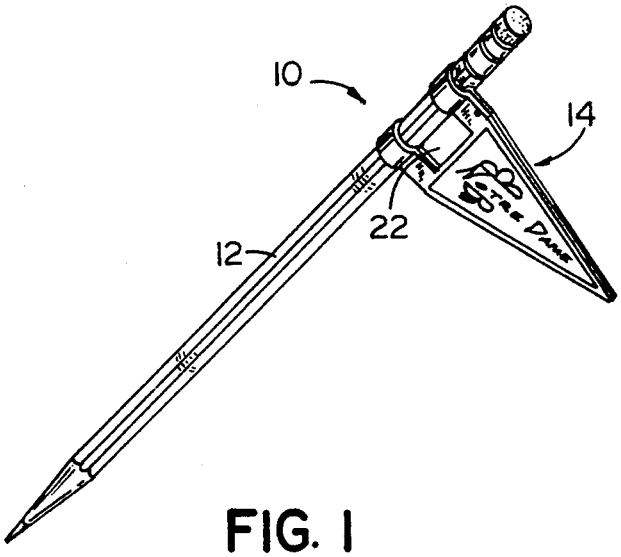
FIG. 1 is a perspective view of the novel device attached to a pencil.
Figure 2:
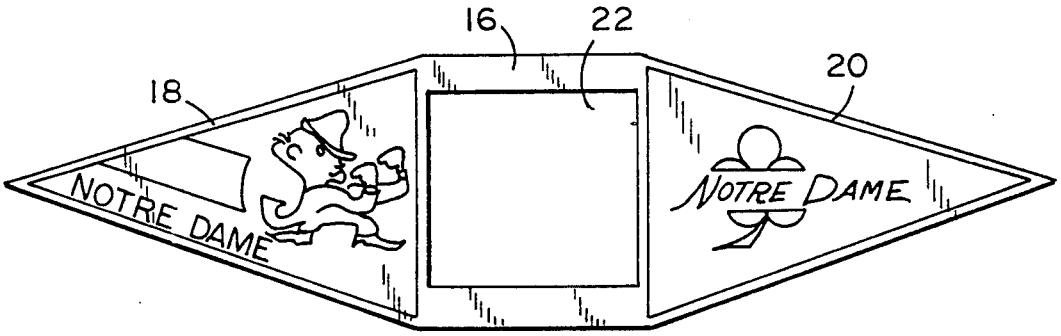
FIG. 2 is a plan view of the device in FIG. 1.
Figure 3:
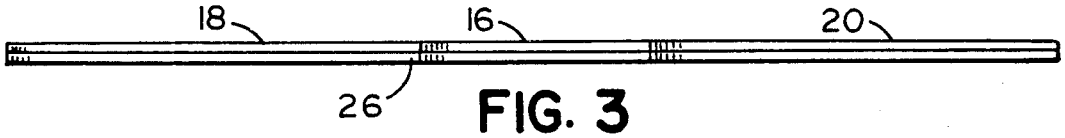
FIG. 3 is a side elevation view of the device in FIG. 2.
Figure 4:
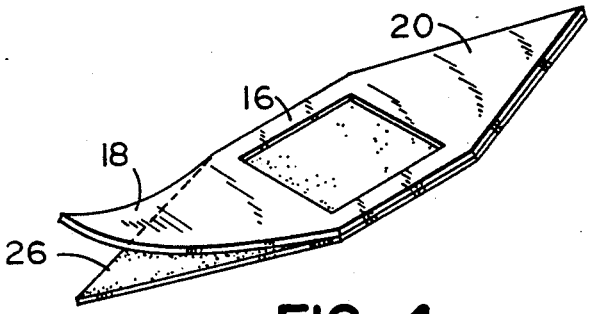
FIG. 4 is a perspective view of the device showing the protective layer being removed.

Referring now specifically to the drawings, the combination 10 there set forth includes a conventional pencil 12, or other equivalent writing instrument, and the novel decorative attachment 14. This decorative attachment when formed includes a central portion 16 and a pair of end portions 18 and 20 astraddle of and integral with the central portion, to form an elongated element having a front face and a rear face. Central portion 16 is of sufficient length to readily wrap around the circumference of pencil 12, and preferably an excess of length so that a cutout space 22 separates the two parallel spaced strips remaining in the central portion, such that when wrapped around the pencil, these strips will appear to be as upper and lower ribbons attaching the end portions of the pennant-like device to the pencil (FIG. 1) The front face of the two end portions 18 and 20 includes decorative indica thereon, here shown by the name and symbol of a particular university, and which may be any of a variety of colors or configurations. The rear face of the end portions and the central portion has an adhesive over its full surface (FIGS. 3 and 4), normally covered by a removable peel-off protective layer 26 coated with a conventional release agent, e.g., a silicone or the like. End portions 18 and 20 ar ®preferably of a triangular configuration tapering to an apex at the outer end thereof spaced from central portion 16, having the appearance of a pennant type of flag.

In use, the student merely peels off the protective layer 26 from the attachment, wraps the central portion 16 around the pencil, preferably with a length sufficient to cause the excess length of spaced straps 16 to engage each other back to back to adhere them together, as well as the end portions being placed back to back in adhesive contact. The flexibility of the strips 16 is such as to enable this wrap around action to occur, but the pennant has sufficient stability to extend basically normal, i.e., transverse, to the pencil. The entire combination effect, therefore, is of a flag, with the pencil comprising the flag pole.

As set forth herein, the details of the structure may be modified in various ways to suit a particular type of use. The invention is intended to be limited only by the scope of the appended claims and the reasonably equivalent structures to those defined therein.

The embodiments of the invention in which an exclusive property or privilege is claimed are defined as follows:

1. A pencil attachment comprising:

an elongated flexible decorative element having a central portion and two end portions on opposite ends of said central portion;

said central portion and said end portions having a front surface and a back surface;

said front surfaces of said end portions having decorative indicia thereon;

said decorative indicia comprising institutional or franchise emblems;

said central portion comprising strips separated by a cutout;

said back surfaces of said central portion and said end portions having adhesive over the full surface thereof, and having a peel-off protector sheet over said adhesive;

said central portion strips having a length of at least an amount to encompass the periphery of a pencil and extend therefrom to resemble ribbons, and having sufficient flexibility to be wrapped around a pencil, whereby said pencil attachment will appear as a flag or pennant on a pencil.

2. The pencil attachment in claim 1 wherein said end portions are tapered to substantially triangular configuration to resemble a pennant.

3. A combination pencil and pencil attachment comprising:

an elongated pencil having a writing element at one end, and a second end;

an elongated flexible decorative element at said second end;

said decorative element having a central portion and a pair of end portions, all said portions having an outer surface and an inner surface;

said outer surfaces of said end portions having decorative indicia thereon;

said decorative indicia comprising institutional or franchise emblems;

said central portion comprising spaced strips separated by a cutout;

said inner surfaces having an adhesive over the full surface thereof;

said central portion strips extending around and adhered to said second end of said pencil and extending therefrom to resemble ribbons, and said end portion inner surfaces being in engagement with and adhered to each other, whereby said elongated decorative element extends transversely to said pencil in a fashion simulating a flag on a pole.

4. The combination in claim 3 wherein said end portions are tapered to substantially triangular configuration to resemble a pennant.

* * * * *